US006564627B1

(12) United States Patent
Sabini et al.

(10) Patent No.: US 6,564,627 B1
(45) Date of Patent: May 20, 2003

(54) DETERMINING CENTRIFUGAL PUMP SUCTION CONDITIONS USING NON-TRADITIONAL METHOD

(75) Inventors: Eugene P. Sabini, Skaneateles, NY (US); Jerome A. Lorenc, Seneca Falls, NY (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/052,946

(22) Filed: Jan. 17, 2002

(51) Int. Cl.[7] ..... G01L 7/00

(52) U.S. Cl. ..... 73/168; 417/19; 417/20; 417/63

(58) Field of Search ..... 73/168; 417/63, 417/19, 20

(56) References Cited

U.S. PATENT DOCUMENTS 4,108,574 A * 8/1978 Bartley et al. ..... 417/19
4,208,171 A * 6/1980 Jonsson ..... 417/15
4,212,590 A * 7/1980 Jonsson ..... 417/24
4,370,098 A * 1/1983 McClain et al. ..... 417/18
5,240,380 A * 8/1993 Mabe ..... 417/43
5,634,772 A * 6/1997 Kawaguchi ..... 417/22
5,651,264 A * 7/1997 Lo et al. ..... 62/230
6,260,004 B1 * 7/2001 Hays et al. ..... 702/183

OTHER PUBLICATIONS

"Operating Efficiency of Crankshaft Drive Pumps", Dr. S. Veenhuizen, Proceedings of the 6th Pacific Rim International Conference on Waterjet Technology, Oct. 9–11, 2000.*

* cited by examiner

*Primary Examiner*—Daniel S. Larkin
*Assistant Examiner*—David A. Rogers
(74) *Attorney, Agent, or Firm*—Ware, Fressola, Van Der Sluys & Adolphson LLP

(57) ABSTRACT

A method for determining the suction pressure of a centrifugal pump including the steps of determining pump torque and pump discharge pressure at at least two different speeds, forming a first order wave curve as a straight line using said pump torque and pump discharge and determining suction pressure from the y axis intercept of said line.

18 Claims, 2 Drawing Sheets

DETERMINING CENTRIFUGAL PUMP SUCTION CONDITIONS USING NON-TRADITIONAL METHOD

RELATED APPLICATIONS

This application is directly related to "Pump Operating State without the Use of Traditional Measurement Sensors" filed on Jan. 9, 2002 and having U.S. Ser. No. 10/042,877 and "Centrifugal Pump Performance Degradation Detection" filed on Jan. 17, 2002 and having U.S. Ser. No. 10/052,942.

FIELD OF THE INVENTION

This invention relates generally to centrifugal pumps, and, more particularly, to an improved method and apparatus for measuring the pressure at the suction side of a centrifugal pump.

BACKGROUND OF THE INVENTION

As is known, a centrifugal pump has a wheel fitted with vanes and known as an impeller. The impeller imparts motion to the fluid which is directed through the pump. A centrifugal pump provides a relatively steady fluid flow. The pressure for achieving the required head is produced by centrifugal acceleration of the fluid in the rotating impeller. The fluid flows axially towards the impeller, is deflected by it and flows out through apertures between the vanes. Thus, the fluid undergoes a change in direction and is accelerated. This produces an increase in the pressure at the pump outlet. When leaving the impeller, the fluid may first pass through a ring of fixed vanes which surround the impeller and is commonly referred to as a diffuser. In this device, with gradually widening passages, the velocity of the liquid is reduced, its kinetic energy being converted into pressure energy. Of course it is noted that in some centrifugal pumps there is no diffuser and the fluid passes directly from the impeller to the volute. The volute is a gradual widening of the spiral casing of the pump. Centrifugal pumps are well known and are widely used in many different environments and applications.

The prior art also refers to centrifugal pumps as velocity machines because the pumping action requires first, the production of the liquid velocity; second, the conversion of the velocity head to a pressure head. The velocity is given by the rotating impeller, the conversion accomplished by diffusing guide vanes in the turbine type and in the volute case surrounding the impeller in the volute type pump. With a few exceptions, all single stage pumps are normally of the volute type. Specific speed $N_s$ of the centrifugal pump is $NQ^{1/2}/H^{3/4}$. Ordinarily, N is expressed in rotations per minute, Q in gallons per minute and head (H) in feet. The specific speed of an impeller is an index to its type. Impellers for high heads usually have low specific speeds, while those for low heads have high specific speeds. The specific speed is a valuable index in determining the maximum suction head that may be employed without the danger of cavitation or vibration, both of which adversely effect capacity and efficiency. Operating points of centrifugal pumps are extremely important.

There are several common methods to identify the pressure at the suction side of a centrifugal pump. One common technique is the use of any type of pressure measurement device, which would include pressure transmitters, pressure transducers, bourdon tube gages and manometers. These are connected directly to the suction pipe near the pump and therefore measure the suction pressure. Certain pumps which are installed at the outlet side of vented tanks for the purpose of controlling tank level have their suction pressure calculated using the level in the tank. For example, knowing the pump's hydraulic characteristics along with its actual speed, flow and discharge pressure, the suction pressure is and can be calculated.

Essentially, one can monitor the level in the tank to determine how fast the level goes down and how fast the level goes up and by taking various measurements to determine the suction pressure of the pump. While these devices are relatively widely employed, direct pressure measurement at the suction inlet of a centrifugal pump is the most accurate and direct measurement that is presently employed. The more serious drawback is that the approach requires a breach of the pumped suction pipe. Where the pumpage is highly flammable, caustic or environmentally dangerous, this could be a tremendous detriment. In this manner, once there is a breach of the suction pipe, the unit, which is normally connected to an electrical source, can cause ignition or combustion of the pumpage material and so on.

Calculating the suction pressure of a pump using the upstream tank level is not as accurate as direct pressure measurement. At high flow rates, the friction losses are not taken into consideration. There are a lot of changes in pumpage temperature and specific gravity and these changes also result in errors in calculation. The method of using the pump's hydraulic characteristic is an indirect one. This method requires the use of a pump discharge pressure transmitter, a flow meter and a speed sensor. Additionally, the hydraulic performance of the pump has to be known. Specific gravity changes in the pumped fluid will result in errors. Net velocity head corrections to the total dynamic head (TDH) of the pump requires additional information and calculations. The approach assumes that the performance of the pump is in total agreement with the hydraulic data sheet. Unfortunately, often this is not true.

The present invention describes a new method and apparatus which eliminates many of the shortcomings of the prior art devices. The present method does not require any traditional instruments, and does not require a breach of the suction piping to directly measure pressure. The technique to be described is not effected by line losses and there is no need to know the pump's hydraulic performance.

SUMMARY OF THE INVENTION

The present invention requires the use of a variable speed drive (VSD) for the pump motor. The drive utilized has the ability to characterize the motor to obtain torque supplied by the motor and the actual motor running speed. This feature, is provided in most variable frequency drives as presently implemented in today's technology. The present invention requires that the pump discharge pressure and torque be measured at at least two different speeds. Discharge pressure is plotted versus torque. A first order curve (line) is fitted through the two points and where the line crosses the discharge pressure (y-axis) determines the suction pressure value.

As indicated, the above invention can be used on any centrifugal pump where the torque applied to the pump and the pump speed and pump discharge pressure is known. This can also be accomplished by the use of a torque shaft between the motor and pump and a pump discharge pressure transducer. Most torque shafts have apparatuses providing the ability to measure speed. Driving the pump is a variable frequency drive (VFD) and the pump discharge pressure transducer. As indicated, VFDs built today can characterize the motor and calculate both the torque generated by the motor and the actual speed of the motor.

The pump discharge pressure must be measured with an absolute pressure sensor, with a gage pressure sensor is used some barometric pressure sensor, indicator input needs to be employed. As indicated, the invention requires that pump discharge pressure and torque be measured at two different speeds. Discharge pressure is plotted against torque. This produces a first order curve or line which is fitted through the two points plotted. Where this line crosses the discharge pressure, is the value through a pump suction pressure. This will be explained in conjunction with the Detailed Description.

BRIEF DESCRIPTION OF THE DRAWINGS

Other aspects, advantages and novel features of the invention will become more apparent from the following detailed description of the invention when considered in conjunction with the accompanying drawings wherein.

DETAILED DESCRIPTION

Figure 1:
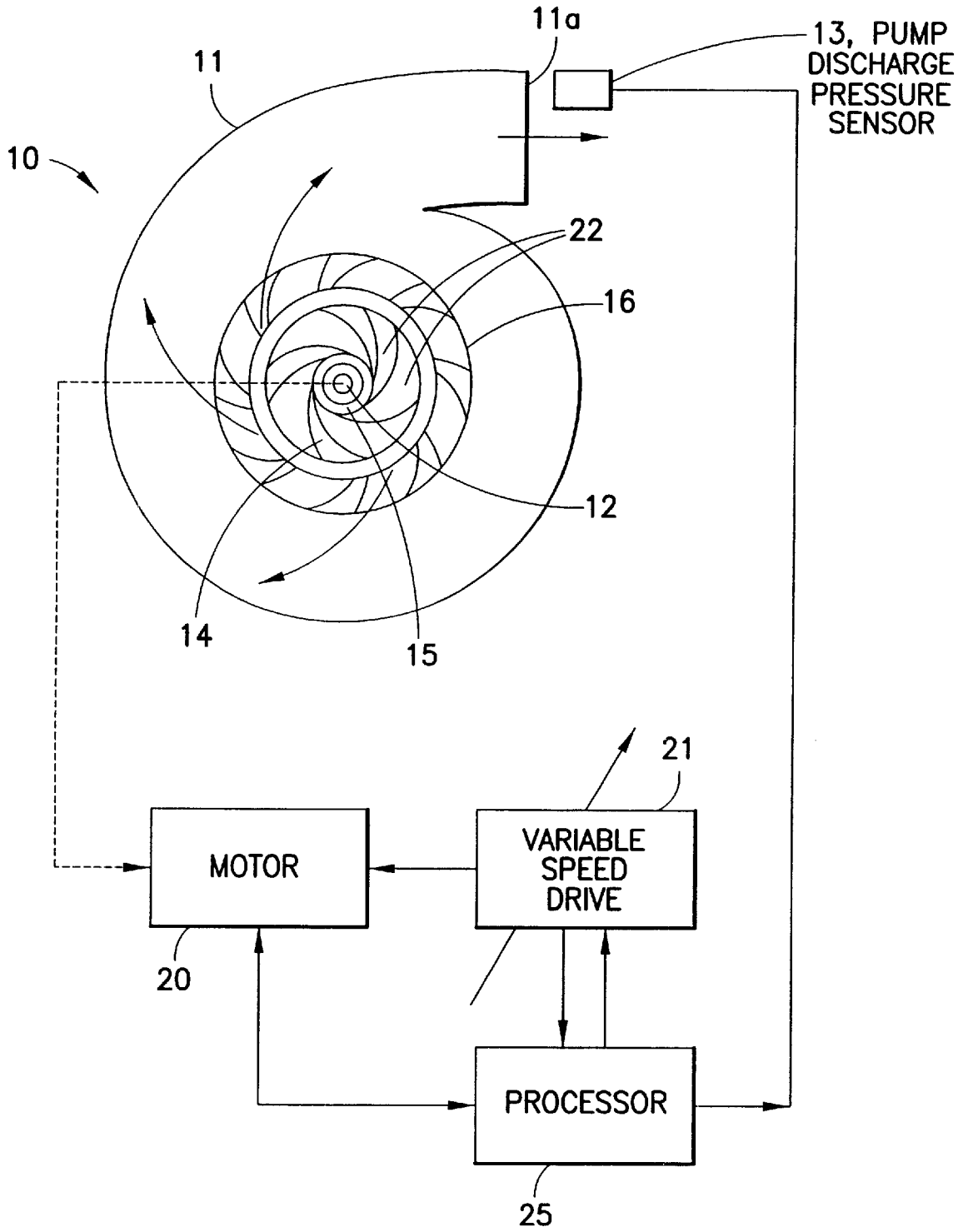
FIG. 1 is a schematic depicting a centrifugal pump driven by a motor having a variable speed drive according to an aspect of this invention.
Figure 2:
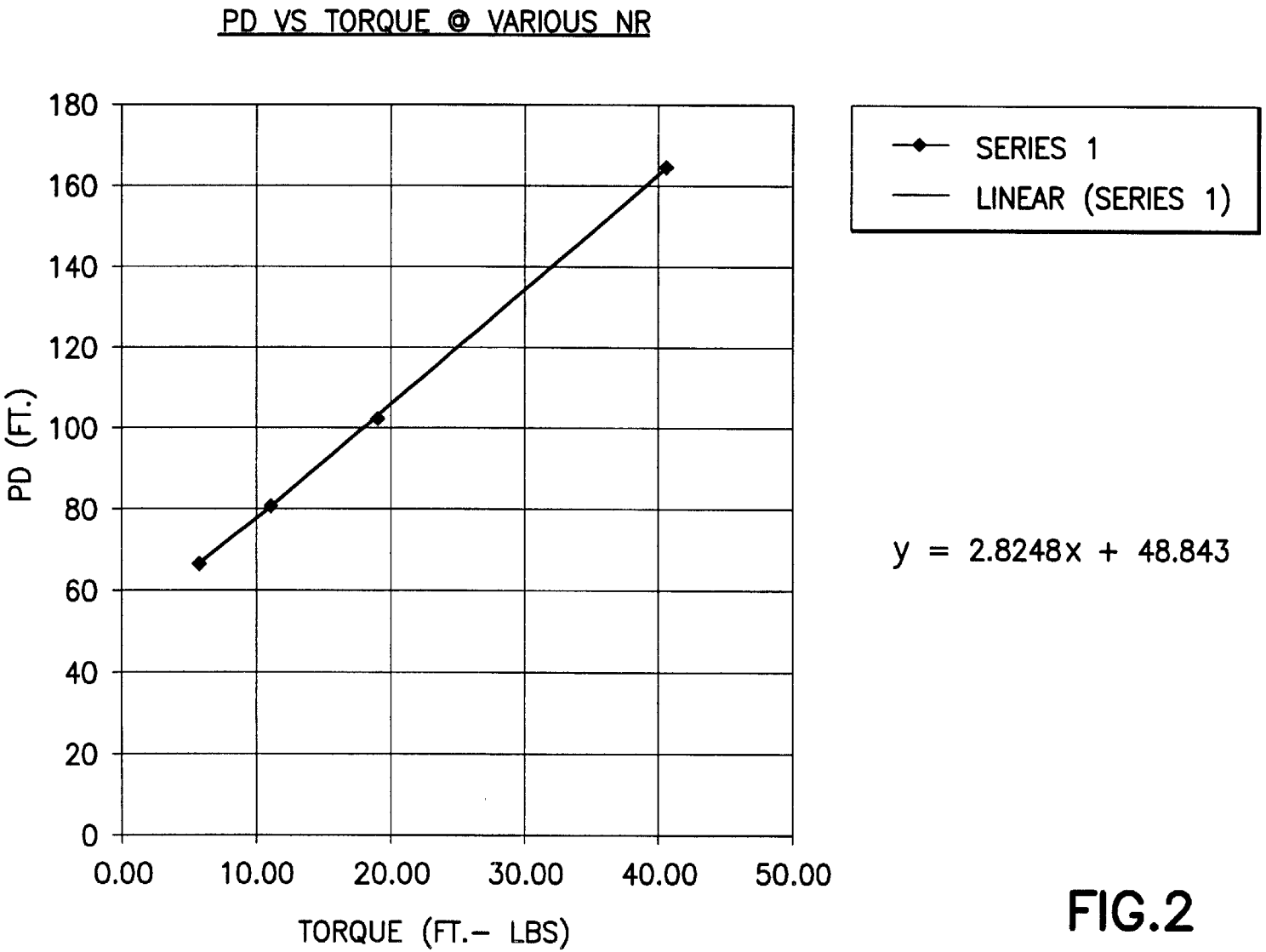
FIG. 2 is a series of graph depicting discharge pressure Pd versus torque and taken at various speeds.

Referring to FIG. 1, there is shown a schematic view of a typical centrifugal pump 10. The centrifugal pump 10 has a housing 11 which contains a central drive shaft 12 The drive shaft 12 is coupled to and spaced from an impeller member 14. There is a space 15 between the drive shaft 12 and the impeller 14 which allows for the inlet of a fluid or substance to be pumped. The fluid can be water or any other suitable material. As indicated, a centrifugal pump may include a diffuser 16 The diffuser is not necessary and is shown by way of example. As can be seen, the impeller 14 includes a series of blades or vanes and is rotated by means of the drive shaft 12 The drive shaft 12, as seen, is mechanically coupled to a motor 20 which in turn is driven in this particular invention by a variable speed drive apparatus 21. As shown, a pump discharge pressure sensor 13 is coupled in relation to a discharge port 11*a* of the centrifugal pump 11 and the processor 25.

Essentially, the arrows show the flow of fluid through the centrifugal pump. The centrifugal pump provides a relatively steady flow. The pressure for achieving the required delivery head is produced by centrifugal acceleration of the fluid in the rotating impeller 14. The fluid flows axially towards the impeller, is deflected by the impeller and is discharged through the apertures or spacings 22 between the vanes of the impeller 22 Thus, the fluid experiences a change in direction and is therefore accelerated which produces an increase in pressure at the pump outlet. When the fluid leaves the impeller, the fluid passes through a ring of fixed vanes which surround the impeller and, as indicated, is referred to as a diffuser 16 A diffuser 16 has gradually widening passages where the velocity of the liquid being pumped is reduced. Basically, the diffuser, as indicated, works so that kinetic energy is converted into pressure. This conversion is completed by the volute of the pump which is the gradual widening of the spiral casing. As indicated, some pumps have no diffuser and the fluid passes directly from the impeller to the volute.

In any event, as seen, the centrifugal pump is operated by means of a motor. The output shaft of the motor is coupled to the drive shaft 12. The motor is capable of variable speed drive as controlled by a variable speed drive circuit. Variable drive circuits for motor control are well known and essentially, an adjustable, varying speed motor is one where the speed can be adjusted. Variable speed motors are well known and, for example, motor control can be implemented by many different techniques. There are control circuits which control the speed of the motor which supply a variable width and variable frequency signal which, for example, has a duty cycle and a frequency dependent on the current directed through the motor. Such control devices are implemented using current feedback to sense motor speed. Such circuits can control the speed of the motor by varying the pulse width as well as pulse frequency. Speed control by frequency variation is referred as Variable Frequency Drive (VFD). The entire field of motor control is quite well known. Speed control can be implemented by the use of thyristors or SCR's and in certain situations is analogous to light dimming circuits.

A variable speed or VFD device accurately enables one to calculate the motor speed and torque.

As shown in FIG. 1, there is a processor 25 which essentially may be included in the variable speed drive circuitry 21 and is responsive to motor rotation or torque. The function of the processor, as will be explained, is to solve or process the Affinity Laws governing the operation of centrifugal motors. It is understood that the processor 25 may contain a microprocessor which would further include a random access memory or other memory means having stored therein the various characteristics of a particular pump. The processor 25 can also control the variable speed drive to enable automatic operation during a test period at different speeds.

The invention provides a method for use by the processor 25 in determining the suction pressure $P_s$ of a centrifugal pump. The method assumes a linear relationship between the discharge pressure $P_d$ and the pump torque T, namely, $$P_d = Mt + P_s,$$

in which m is a constant, and the suction pressure $P_s$ is also a constant. The method requires obtaining the pump torque T and the pump discharge pressure $P_d$ at two different speeds, and using the assumed linear relationship. The assumed linear relationship between the torque T and discharge pressure $P_d$ can be shown to hold true as described next.

The assumed linear relation between the torque T and a the discharge pressure $P_d$ can be proven by algebraic manipulation of basic pump equations and pump Affinity Laws. The proof is as follows.

$$BHP = (T*N)/K \qquad 1.$$

BHP is Break Horsepower

T is Torque

N is pump speed

K is conversion constant

2. One of the Affinity Law relationships is:

$$\frac{(BHP1)}{(BHP2)} = \frac{(N1)\wedge 3}{(N2)\wedge 3}$$

3. Substituting the equation in step 1 into equation in step 2 one gets:

$$\frac{(T1*N1)/K}{(T2*N2)/K}=\frac{(N1)\wedge 3}{(N2)\wedge 3}$$

4. Simplifying equation in step 3 results in the following relationship:

$$\frac{(T1)}{(T2)}=\frac{(N1)\wedge 2}{(N2)\wedge 2}$$

5. Another Affinity Law relationship is:

$$\frac{(N1)\wedge 2}{(N2)\wedge 2}=\frac{(TDH1)}{(TDH2)}$$

TDH is the Total Dynamic Head of the pump.

6. Substituting the equation in step 4 into the equation in step 5 results in:

$$\frac{(T1)}{(T2)}=\frac{(TDH1)}{(TDH2)}$$

7. Reviewing the equation for TDH of a pump:

$$TDH=(Pd-Ps)/SG+hv+Z$$

Pd is pressure on the discharge of the pump.

Ps is pressure on the suction of the pump.

hv is net velocity head across the pump.

Z is height correction of between suction and discharge taps to pump datum.

8. This invention makes the assumption that during short periods of time, the pump's suction conditions do not change, pumpage specific gravity does not change and that the net velocity head across the pump for the changes in speed required to establish the torque versus Pd relations is negligible. Since Z is also a constant, equation 7 can be reduced to show that TDH is only directly proportional to pump discharge pressure (Pd).

9. Using the results of step 8 and substituting into the equation in step 6 one is left with:

$$\frac{(T1)}{(T2)}$$

is directly proportional to $$\frac{(Pd1)}{(Pd2)}$$

Essentially, the pump Affinity Laws are used in the design of testing centrifugal pumps and compressors to predict their performance when the speed of the unit is changed. The laws are:

1. The flow through unit is directly proportional to the speed;
2. The head developed is proportional to the speed squared;,
3. The horse power is proportional to the speed cubed; and,
4. The efficiency remains approximately constant.

Although the invention has been described in terms of exemplary embodiments, it is not limited thereto. Rather, the appended claims should be construed broadly, to include other variants and embodiments of the invention which may be made by those skilled in the art without departing from the scope and range of equivalents of the invention.

What is claimed is:

1. An apparatus for determining a suction pressure of a centrifugal pump, comprising:

means for measuring a first signal containing information about a centrifugal pump torque at at least two different speeds;

means for measuring a second signal containing information about a centrifugal pump discharge pressure at the at least two different speeds; and means for transforming the first signal and the second signal into a third signal containing information about the suction pressure of the centrifugal pump for use in determining the operation of the centrifugal pump.

2. An apparatus according to claim 1, wherein the means for transforming includes a processor for plotting values of the first signal against the second signal so as to produce a first order curve or line which is fitted through two points corresponding to the at least two different speeds.

3. An apparatus according to claim 2, wherein the means for plotting includes a processor for determining a straight line from the values using a first order equation:

$$y=M*T+P_s,$$

where y=the pump discharge pressure,

M=the slope of the straight line,

T=the pump torque, and $P_s$=the pump suction pressure.

4. An apparatus according to claim 3, wherein the processor uses a fundamental relationship between brake horsepower and torque and a fundamental relationship between total dynamic head and discharge pressure and uses pump Affinity Laws to determine the pump discharge pressure and pump torque at the at least two different speeds.

5. An apparatus according to claim 4, wherein the processor determines said pump torque T using a step of measuring speed and using the pump Affinity Laws to determine Brake Horsepower at the speed, and then using the relation:

$$BHP=T*N/K,.$$

wherein BHP is the Brake Horsepower, T is the Torque, N is pump speed, and K is a conversion constant.

6. An apparatus according to claim 1, wherein the processor determines the suction pressure with a first order equation by setting the value of the pump torque equal to zero.

7. An apparatus according to claim 1, wherein the means for measuring the first signal includes a variable speed drive coupled to a shaft of a motor.

8. An apparatus according to claim 1, wherein the means for measuring the second signal includes a pressure sensor coupled to a discharge port of the centrifugal pump.

9. An apparatus according to claim 1, wherein the means for measuring including means for measuring the first signal and the second signal at four different speeds.

10. A method of determining a suction pressure of a centrifugal pump, comprising the steps of:

measuring a first signal containing information about a centrifugal pump torque at at least two different speeds;

measuring a second signal containing information about a centrifugal pump-discharge pressure at the at least two different speeds; and transforming the first signal and the second signal into a third signal containing information about the suction pressure of the centrifugal pump for use in determining the operation of the centrifugal pump.

11. A method according to claim 10, wherein the step of transforming includes a step of plotting values of the first signal against the second signal so as to produce a first order curve or line which is fitted through two points plotted.

12. A method according to claim 10, wherein the step of transforming includes a step of determining a straight line from the values using a first order equation:

$$y=M*T+P_s,$$

where y=the pump discharge pressure,

M=the slope of the straight line,

T=the pump torque, and $P_s$=the pump suction pressure.

13. The method according to claim 12, wherein the step of transforming includes a step of using a fundamental relationship between brake horsepower and torque and a fundamental relationship between total dynamic head and discharge pressure and using pump Affinity Laws to determine the pump discharge pressure and pump torque at the at least two different speeds.

14. The method according to claim 13, wherein the step of determining the pump torque includes measuring speed and using the pump Affinity Laws to determine Brake Horsepower at the speed, and then using the relation:

$$BHP=T*N/K,$$

wherein BHP is the Brake Horsepower, T is the Torque, N is pump speed, and K is a conversion constant.

15. A method according to claim 10, wherein the step of transforming includes a step of determining suction pressure with a first order equation by setting the value of the pump torque equal to zero.

16. A method according to claim 10, wherein the step of measuring the first signal includes a step of using a variable speed drive coupled to a shaft of a motor.

17. A method according to claim 10, wherein the step of measuring the second signal includes a step of using a pressure sensor coupled to a discharge port of the centrifugal pump.

18. A method according to claim 10, wherein the steps of measuring includes measuring the first signal and the second signal at four different speeds.

* * * * *

UNITED STATES PATENT AND TRADEMARK OFFICE

CERTIFICATE OF CORRECTION

PATENT NO. : 6,564,627 B1 
DATED : May 20, 2003
INVENTOR(S) : Eugene P. Sabini and Jerome A. Lorenc It is certified that error appears in the above-identified patent and that said Letters Patent is hereby corrected as shown below:

Column 3,
Line 37, after “16” -- . -- should be inserted.
Line 40, after “12” -- . -- should be inserted.
Line 53, after “22” -- . -- should be inserted.
Line 58, after “16” –first instance–, -- . -- should be inserted.

Column 4,
Line 52, after “follows” “.” Should be -- : --

Column 7,
Line 2, after “pump” “-” should be deleted.

Signed and Sealed this

Fourteenth Day of September, 2004

JON W. DUDAS
*Director of the United States Patent and Trademark Office*